US011644276B2

(12) United States Patent
Sessions et al.

(10) Patent No.: US 11,644,276 B2
(45) Date of Patent: May 9, 2023

(54) AIMING OR VIEWING DEVICE WITH PROGRAMMABLE ILLUMINATOR

(71) Applicant: LEUPOLD & STEVENS, INC., Beaverton, OR (US)

(72) Inventors: Julian Sessions, Beaverton, OR (US); Thomas E. Moyle, Hillsboro, OR (US); Frederick A. Azinger, Portland, OR (US); Timothy John Lesser, Sherwood, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 17/859,406

(22) Filed: Jul. 7, 2022

(65) Prior Publication Data

US 2022/0349673 A1 Nov. 3, 2022

Related U.S. Application Data

(63) Continuation of application No. 17/150,649, filed on Jan. 15, 2021, now Pat. No. 11,415,389.

(60) Provisional application No. 62/962,654, filed on Jan. 17, 2020.

(51) Int. Cl.
*F41G 1/30* (2006.01)
*F41G 1/34* (2006.01)

(52) U.S. Cl.
CPC ..... *F41G 1/30* (2013.01); *F41G 1/345* (2013.01)

(58) Field of Classification Search
CPC ..... F41G 1/30; F41G 1/345
USPC ..... 42/113
See application file for complete search history.

(56) References Cited

U.S. PATENT DOCUMENTS

| | | | | |
|---|---|---|---|---|
| 11,415,389 | B2 * | 8/2022 | Sessions | F41G 1/30 |
| 2011/0297744 | A1 * | 12/2011 | Schneider | F41G 1/467 235/414 |
| 2012/0151816 | A1 * | 6/2012 | Kleck | F41G 1/30 42/111 |
| 2020/0049455 | A1 * | 2/2020 | Hamilton | F41G 1/38 |
| 2021/0207928 | A1 * | 7/2021 | Brewer | F41G 1/16 |

* cited by examiner

*Primary Examiner* — Samir Abdosh
(74) *Attorney, Agent, or Firm* — Schwabe, Williamson & Wyatt, PC

(57) ABSTRACT

A reflex sight for a firearm has a body, a mounting facility, a controller, an actuator, and an illumination facility operably connected to the controller and having a plurality of different operating states. The controller is responsive to sequential actuation of the actuator to cycle among the operating states. The controller is operable to change operation of the illumination facility after a selected duration based on a power consumption characteristic of the operating state.

20 Claims, 2 Drawing Sheets

AIMING OR VIEWING DEVICE WITH PROGRAMMABLE ILLUMINATOR

CROSS-REFERENCE TO RELATED APPLICATIONS

This application is a Continuation of U.S. patent application Ser. No. 17/150,649, filed on Jan. 15, 2021, now issued as U.S. Pat. No. 11,415,389, entitled "GUNSIGHT WITH PROGRAMMABLE ILLUMINATOR AND TRAINING MODE," which claims the benefit of U.S. Provisional Patent Application No. 62/962,654, filed on Jan. 17, 2020, entitled "Gunsight with Programmable Illuminator and Training Mode", which are hereby incorporated by reference in their entirety for all that is taught and disclosed therein.

FIELD OF THE INVENTION

The present invention relates to a riflescope or other aiming or viewing device that relies on an illuminator or other powered function.

BACKGROUND AND SUMMARY

Traditional riflescopes rely on an illuminator or other powered function.

This illuminator or powered function is subject to power depletion or interruption.

The above disadvantage is addressed by a reflex sight for a firearm which has a body, a mounting facility, a controller, an actuator, and an illumination facility operably connected to the controller and having a plurality of different operating states. The controller is responsive to sequential actuation of the actuator to cycle among the operating states. The controller is operable to change operation of the illumination facility after a selected duration based on a power consumption characteristic of the operating state.

DETAILED DESCRIPTION OF A PREFERRED EMBODIMENT

Figure 1:
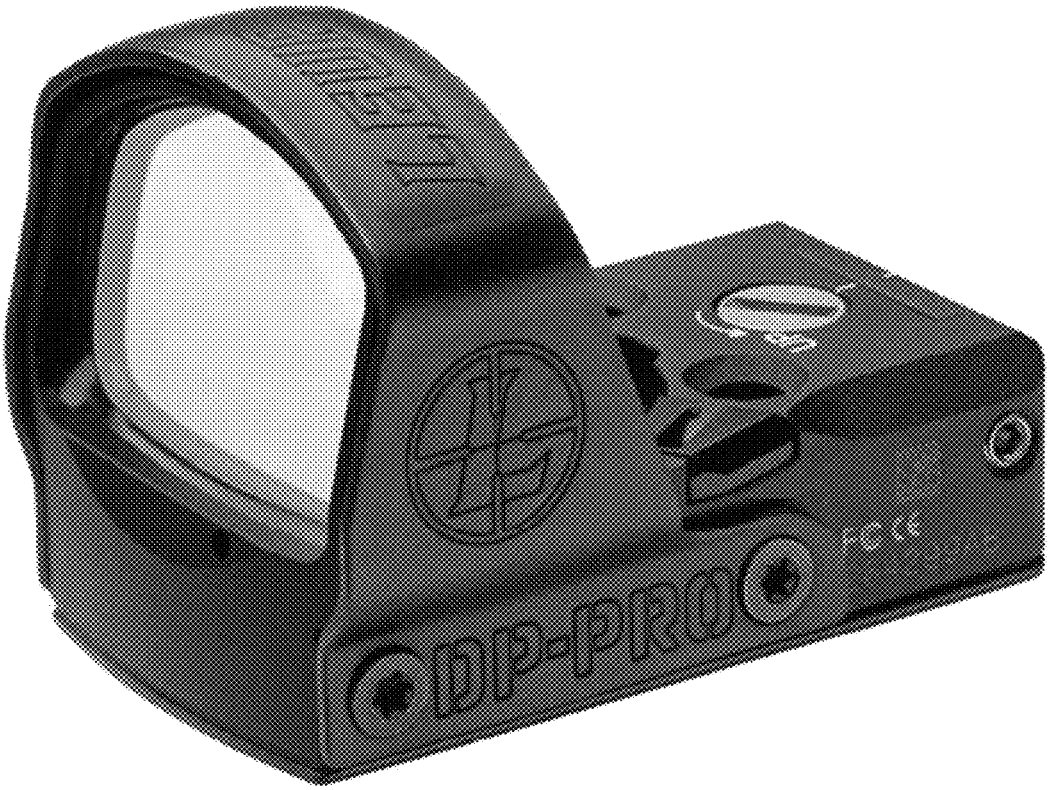
FIG. 1 is a view of the gunsight.
Figure 2:
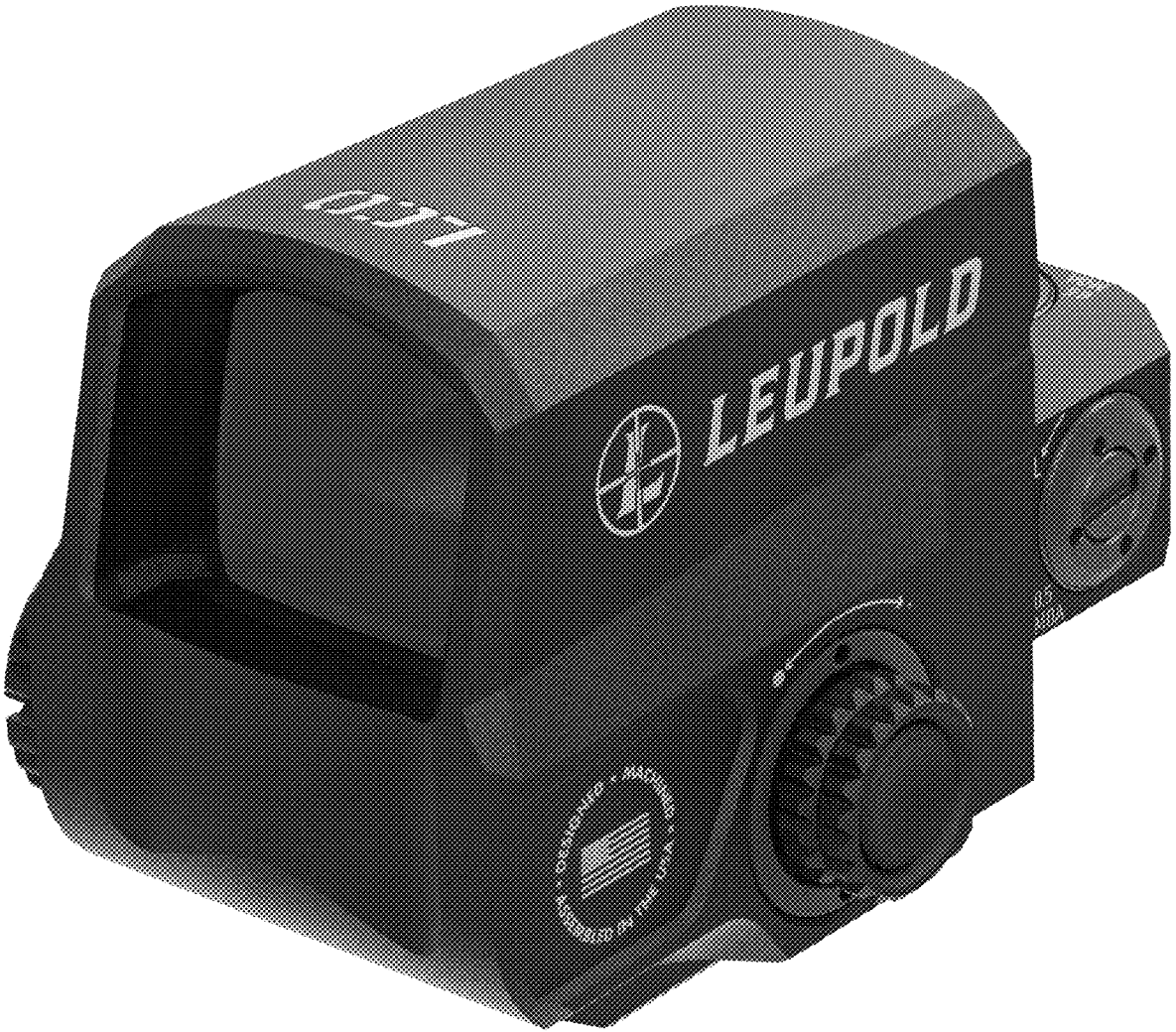
FIG. 2 is a view of the gunsight.

A firearm-mountable reflex or red dot sight that employs conventional optical technology but operates in a manner that includes multiple programmable LED illumination where reference is made to compact reflex sights, the principles may be applied readily to any riflescope or other aiming or viewing device that relies on an illuminator or other powered function that is subject to potential power depletion or interruption.

Multiple illumination levels are made available to the user, and the actual illumination provided by these levels are programmable (All levels could be programmable, but in one preferred embodiment only three are enabled).

The illumination is regulated by the combination of a resistance in series with the LED and pulse width modulation (PWM). Alternatively, one may employ pulse frequency modulation or pure resistive networks to implement illumination. PWM gives an advantage since it is requires few resistors and the PWM frequency is fixed which means LED flicker is predictable.

The preferred embodiment employs a single button interface for simplicity of operation and to provide manufacturing advantages, and timed "button hold" sequences to program the illumination setpoints (each nominally 100%). A button hold distinguishes between brief actuations of the button, and prolonged actuations of different durations, with visual or audible feedback to the user when a duration of hold has been received.

Limits are placed on the brightness setpoints (low limit of 40% and high limit of 250%), so they stay within the realizable range of PWM on a fixed resistor. This may mean that over-driving the LED beyond its rating designed to provide long product life is tolerated controllably for limited durations that do not significantly impair product life or risk failure. In one embodiment, the adjustment is made by altering the PWM duty cycle, however it can also be achieved by other means, such as programmatically combining fixed resistors while not changing the "ON time". The key point being the user programmable mode of operation.

Each brightness setpoint converts to a duty cycle modification factor, which controls the time duration that the LED is lit before being turned off (the "ON" time). The LED is repetitively pulsed for this "ON time" at high rate to avoid flicker. We use approximately 1300 cycles per second. In a preferred embodiment, an abbreviated duration until the automatic shutoff is used for brighter settings to reduce battery depletion, while a longer duration is tolerated for lower power settings.

Storage for the programmable levels is implemented in non-volatile memory so programmable levels can be recalled when the battery is changed after an interval when no power is provided to the memory circuitry.

Optimally, the number of illumination levels may be set at any number, including one. For example, the preferred embodiment has 10 levels. However, a user may want only four. Using button control input, the user could remove levels, and set the illumination precisely where the user would like those 4 levels to be set, so user could arrive the desired setting without needing to cycle through any undesired "factory" illumination levels. This simplifies user operation to select from among a limited number of useful levels without the added time and effort of bypassing selections that are never needed.

The reflex sight can also be set to 'training mode' that causes random shut offs to simulate failure, requiring the user to transition to back-up sights, iron sights, etc. mid-shot. This mode is selected by user input, and may be accompanied by a warning indicator (e.g. illuminator flicker, second warning light, periodic audible alarm) that helps ensure that user does not leave the device in prone-to-fail mode when the user is relying on the device during normal operation. One warning alternative may be an automatic reversion to normal mode after a suitable interval (perhaps an hour) that allows for training. A remote transducer employing wireless technology (e.g. wi-fi, Bluetooth) may connect to a network that enables external control of the device, specifically external ability to "fail" the reflex sight illuminator for training purposes. Specifically, an instructor or a system administering an exercise may cause an individual user's (or all those engaged in a group exercise or parallel training) sight to fail to train and test for adaptation to failure.

The 'trainer' mode can also be accomplished by adding or dedicating a replaceable module that has a code to randomly generate the failure mode scenario. The module randomly generates the failure/recover and repeats at random intervals. The future path would then transition to the Bluetooth solution mentioned.

We claim:

1. A sight for a firearm, the sight comprising:
a body;
a mounting facility;
a controller;
a user interface;
an illumination facility operably connected to the controller and having two or more different operating states with different illumination set points, respectively;
the controller responsive to sequential first actuation of the user interface to cycle among the operating states and further responsive to a second different actuation of the user interface to select:
one or more of the operating states for bypassing in a next cycle among the operating states, or
at least one new illumination setting corresponding to at least one of the illumination set points; and
a memory coupled to the controller and to store programming data generated based on the second different actuation of the user interface, wherein the programming data corresponds to the at least one new illumination setting or is indicative of the one or more operating states selected for bypassing.

2. The sight of claim 1, wherein at least one of the two or more different operating states has a different power consumption characteristic than another one of the two or more different operating states.

3. The sight of claim 1, wherein the user interface comprises a single actuator arranged for operating in a plurality of modalities, including a first intermittent actuation modality and a second different modality.

4. The sight of claim 3, wherein the single actuator comprises a button intermittently actuatable to generate a first input according to the first intermittent actuation modality and differently actuatable to generate a second input according to the second different modality.

5. The sight of claim 3, wherein the controller is configured to generate feedback to indicate one or more characteristics of the generated programming data.

6. The sight of claim 5, wherein the feedback is generated using a component of the user interface that is different than a light source of the illumination facility.

7. The sight of claim 6, wherein the feedback comprises audio feedback.

8. The sight of claim 5, wherein the feedback comprises visual feedback.

9. The sight of claim 5, wherein the feedback is generated using a light source of the illumination facility.

10. The sight of claim 1, the controller to convert the at least one new illumination setting to a duty cycle modification and to control the illumination facility using the duty cycle modification.

11. The sight of claim 2, the controller to power down the illumination facility following operation of the illumination facility for a first period of time and according to the at least one operating state of the operating states, the controller to power down the illumination facility following operation of the illumination facility for a second different period of time and according to the other operating state of the operating states.

12. The sight of claim 1, the controller to regulate illumination of the illumination facility using Pulse Width Modulation (PWM).

13. The sight of claim 12, the controller to regulate illumination of the illumination facility using resistance in series with PWM.

14. The sight of claim 1, the controller to regulate illumination of the illumination facility using pulse frequency modulation.

15. The sight of claim 1, further comprising means for regulating illumination of the illumination facility, wherein the regulation means consists of a resistive network.

16. The sight of claim 1, wherein the memory comprises non-volatile memory.

17. An apparatus, comprising:
an aiming or viewing device including one or more lenses, the aiming or viewing device including:
a controller;
a user interface;
an illumination facility operably connected to the controller and having two or more different operating states with different illumination set points, respectively;
the controller responsive to sequential first actuation of the user interface to cycle among the operating states and further responsive to a second different actuation of the user interface to select:
one or more of the operating states for bypassing in a next cycle among the operating states, or
at least one new illumination setting corresponding to at least one of the illumination set points; and
a memory coupled to the controller, the memory to store programming data generated based on the second different actuation of the user interface, wherein the programming data corresponds to the at least one new illumination setting or is indicative of the one or more operating states selected for bypassing.

18. The apparatus of claim 17, wherein the aiming or viewing device comprises a mounting facility to couple the aiming or viewing device to a firearm.

19. The apparatus of claim 18, wherein the aiming or viewing device comprises a gunsight.

20. The apparatus of claim 19, wherein the aiming or viewing device comprises a body arranged for selectively viewing a target through the gunsight, or iron sights or other back-up sight(s) of the firearm.

* * * * *